US005119955A

United States Patent [19]

Granofsky

[11] Patent Number: 5,119,955

[45] Date of Patent: Jun. 9, 1992

[54] SANITARY CAN CLOSURE

[76] Inventor: Barry P. Granofsky, 7770-G Youngdale, Stanton, Calif. 90680

[21] Appl. No.: 527,434

[22] Filed: May 23, 1990

[51] Int. Cl.[5] ..... B65D 17/34

[52] U.S. Cl. ..... 220/270; 220/257; 220/254; 220/266

[58] Field of Search ..... 220/257, 269, 270, 271, 220/352, 254, 266; 215/255, 320

[56] References Cited

U.S. PATENT DOCUMENTS

| | | | |
|---|---|---|---|
| 3,204,805 | 9/1965 | May | 220/257 |
| 3,269,586 | 8/1966 | Quimby et al. | 220/269 |
| 3,335,893 | 8/1967 | Hanson | 215/254 |
| 3,362,563 | 1/1968 | Koll | 220/269 |
| 3,785,519 | 1/1974 | Huh | 215/254 |
| 4,520,942 | 6/1985 | Dwinell | 220/257 |
| 4,893,725 | 1/1990 | Ball et al. | 220/270 |
| 4,895,270 | 1/1990 | Main et al. | 220/257 |
| 4,927,048 | 5/1990 | Howard | 220/257 |

*Primary Examiner*—Stephen P. Garbe
*Assistant Examiner*—Paul A. Schwarz
*Attorney, Agent, or Firm*—Richard F. Carr; Richard L. Gausewitz; Allan Rothenberg

[57] ABSTRACT

A closure for a beverage can is provided which includes an integral plastic member extending complementarily around the upper end portion of a can, including the side wall and end wall thereof, the member having a plug portion that fits within an opening in the end wall of the can for sealing the same. Scores in the plastic member provide weakened areas resulting in a pull tab by which the plug element is removed from the opening in the can and the closure is removed from the end portion of the can. The plug portion can be reinserted in the opening in the can if less than the entire contents are dispensed. A vent opening also may be provided in the can, sealed by a second plug portion of the can closure.

1 Claim, 2 Drawing Sheets

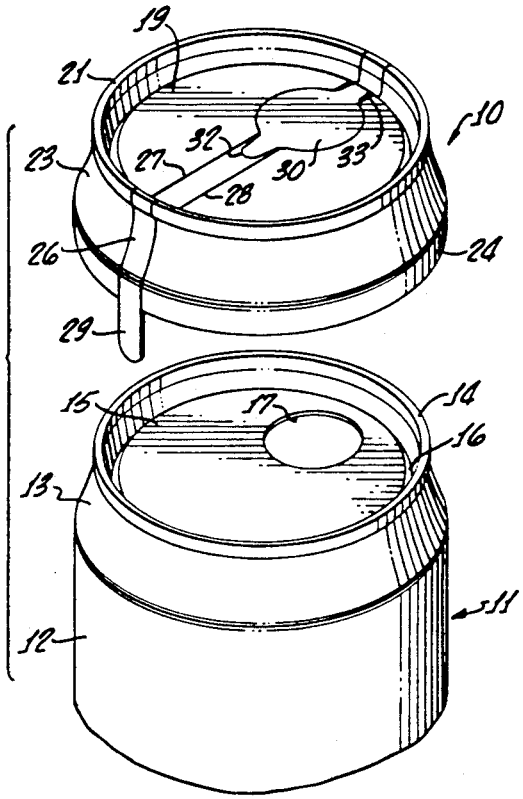
FIG. 3.
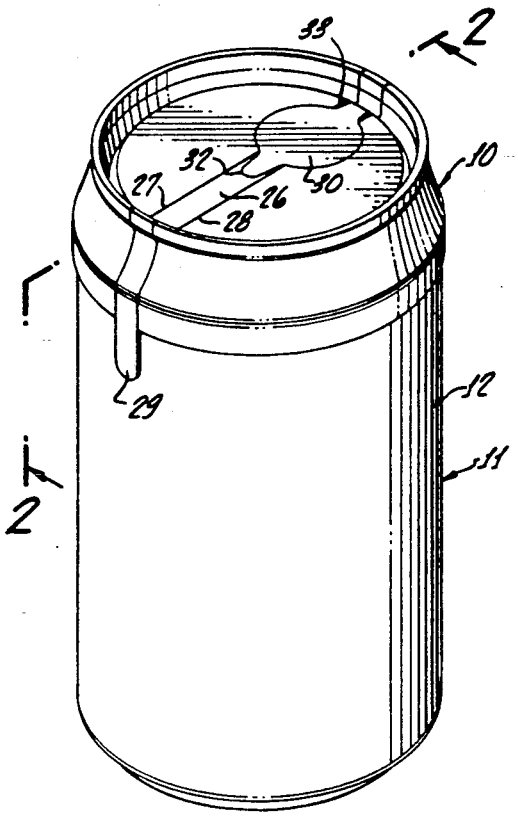
FIG. 1.
FIG. 2.
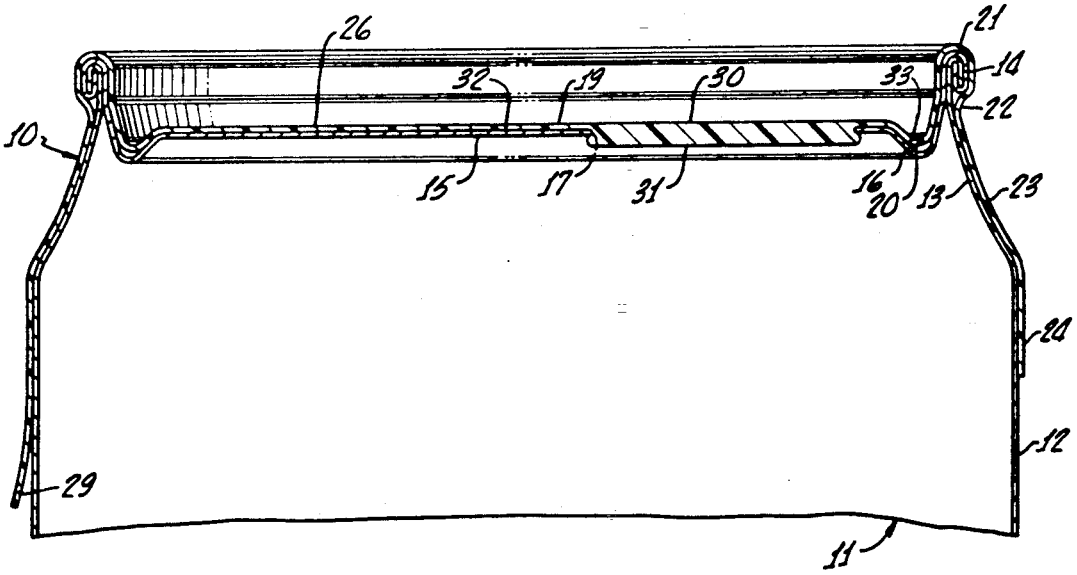

FIG. 4.
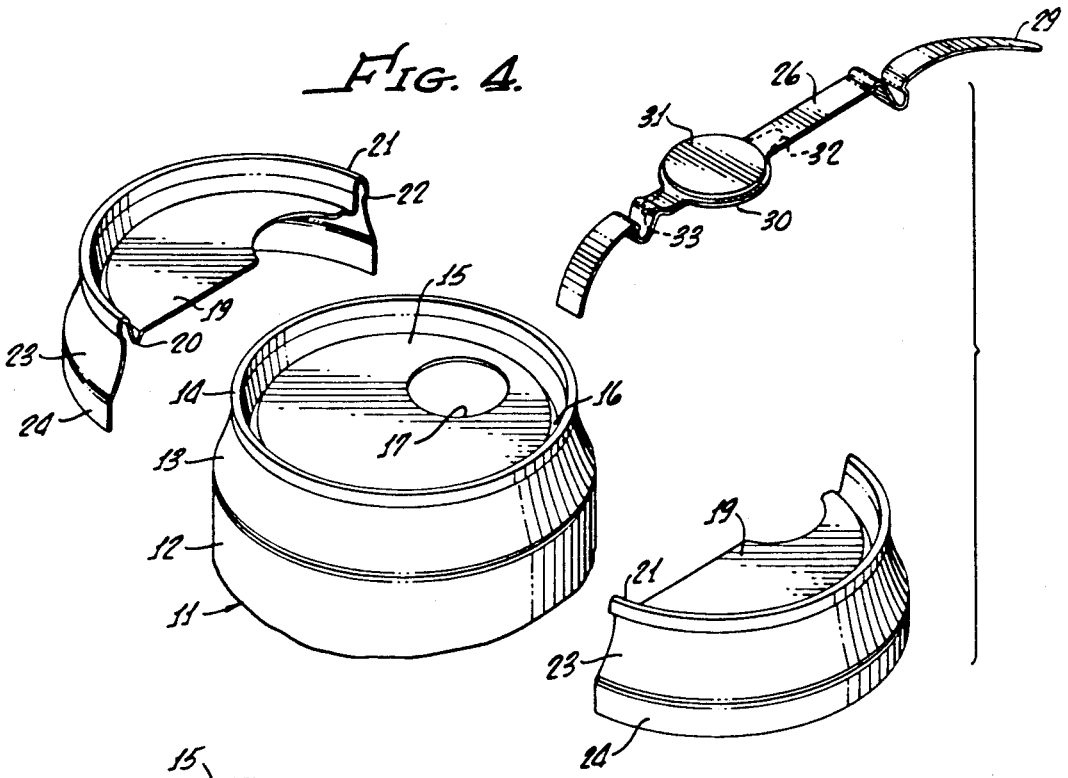
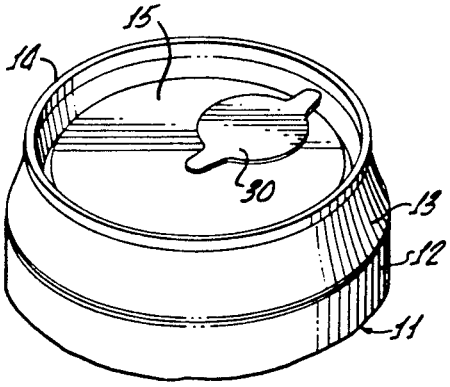
FIG. 5.
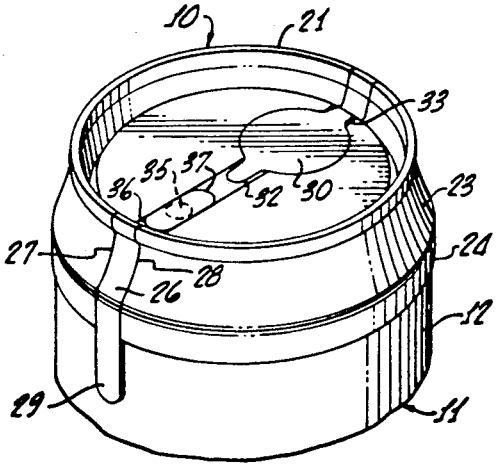
FIG. 6.
FIG. 7.
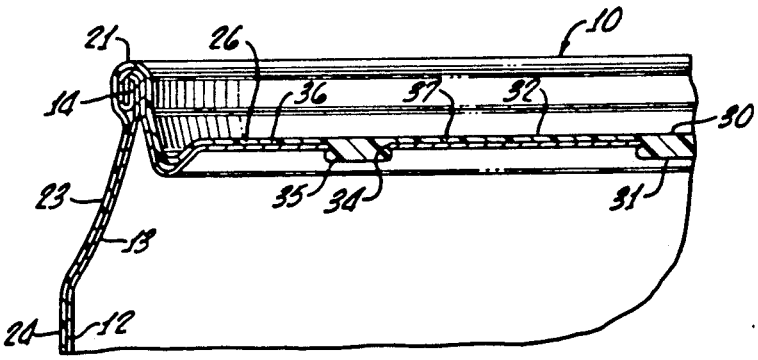

SANITARY CAN CLOSURE

BACKGROUND OF THE INVENTION

Beverage cans, such as for soft drinks, juice and beer, normally include a pivotal lever connected to one end wall which can be rotated upwardly to cause an opening to be formed in the end wall of the can. The opening lever lies close to the end wall of the can and can be difficult to grasp for operation. The opening formed by tearing out a portion of the end wall of the can has sharp edges which can cut the lips of the user if the can is drunk from directly. One of the more serious problems is that the can normally is exposed during shipment and marketing so that it is not sanitary for drinking purposes. Nevertheless, people commonly drink from beverage cans at the risk of contracting a contagious disease.

SUMMARY OF THE INVENTION

The present invention provides an improved can closure which provides a sanitary covering for the end of the can, protecting it so that it will not become contaminated. The closure is more easily manipulated for opening the can than is the conventional lever-operated device for a beverage can. The closure provides the seal for the can so that an opening is formed in the can at the factory and can be rounded at its periphery so that it will not cause injury.

The closure device of this invention is an integral plastic member, preferably a biodegradable plastic, which complementarily overlies the end portion of a can. This includes part of the side wall and an end wall which is normally the top wall of the can. The plastic member includes a thickened portion that acts as a plug, fitting within an opening in the can and sealing the opening. Two spaced scores are provided in the plastic member extending diametrically across it from one edge to the other. These scores are relatively close together except at the plug portion where they extend around the periphery of that part of the member. The scores are such that the material is thinner at the location of the scores and thereby is weakened. A tab projects from one edge of the member at the portion that is between the scores. Therefore, the tab can be grasped and when pulled will split the plastic member along the score lines and will pull the plug portion from the opening in the can. This simultaneously opens the can and uncovers the portion of the can that has been within and protected by the closure element.

Additional transverse scores may be included on either side of the plug portion, interconnecting the scores that extend across the unit. This allows the plug portion to be separated from the remainder of the pull tab. It can then be reinserted into the opening in the can to seal the same in the event that less than the entire contents of the can are dispensed.

If desired, an additional opening may be provided in the end wall of the can to provide a vent to facilitate the dispensing of liquid from the other opening. The vent opening is sealed by a second plug portion on the pull tab and this second plug portion also may be removable from the remainder of the pull tab for reinsertion into the vent opening.

BRIEF DESCRIPTION OF THE DRAWINGS

FIG. 1 is a perspective view of the can closure of this invention associated with a can;

FIG. 2 is an enlarged transverse sectional view taken along line 2—2 of FIG. 1;

FIG. 3 is a fragmentary perspective view showing the can closure prior to association with the can;

FIG. 4 is a fragmentary perspective view showing the removal of the can closure;

FIG. 5 is a fragmentary perspective view illustrating the reinsertion of the plug portion into the opening in the can;

FIG. 6 is a fragmentary perspective view illustrating an alternate embodiment where the closure additionally seals a vent opening in the can; and FIG. 7 is an enlarged fragmentary transverse sectional view taken along line 7—7 of FIG. 6.

DETAILED DESCRIPTION OF THE INVENTION

The closure 10 of this invention is usable with a beverage can 11 which may be in most respects a conventional can such as used for containing soft drinks, juices and beer. The can includes a cylindrical side wall 12 with an inwardly tapered portion 13 adjacent its upper end. A bead 14 extends around the upper perimeter of the can and the upper end wall 15 extends inwardly from the bead. The upper end wall 15 includes an annular recess or trough 16 adjacent the bead 14, but otherwise is flat and in a radial plane. Instead of the lever arrangement for opening a conventional can, the top wall 15 is provided with an opening 17 through it adjacent one edge. The edge of the opening 17 is rounded in the forming process, which may be by stamping, so that it does not present sharp edges which can cause injury.

The can closure 10 is an integral member, preferably of biodegradable plastic, dimensioned to fit complementarily over the upper portion of the beverage can 11. It includes a flat wall 19 that fits over the top wall 15 of the can and an annular rib 20 that fits into the annular recess 16 of the can. At its outer end, the closure 11 includes an annular portion 21 which receives the bead 14, connecting to a short inwardly inclined section 22 which leads to a tapered portion 23 that fits over the tapered wall 13 of the can 11. A relatively short cylindrical section 24 is at the bottom end of the closure and extends around the upper end part of the cylindrical can wall 12. The closure member 10, therefore, completely covers the top end portion of the can 11.

The wall 19 of the closure 10 is constructed to include a pull tab 26 that extends diametrically across it from one side to the other and is used in separating the closure 10 from the can 11. Scores 27 and 28 are provided along the edges of the pull tab 26, each providing a localized thinner wall and thus a weakened frangible portion that enables the pull tab to be separated from the remainder of the closure. The pull tab 26 also includes a downwardly projecting portion 29 that extends below the lower edge of the cylindrical section 24 and beyond the scores 27 and 28. This provides a readily grasped element that is used to pull the pull tab loose to open the can 11.

The scores 27 and 28 are parallel across the portions 19, 20, 21, 22, 23, and 24 of the closure 10, except near the edge of wall 19 where the spacing is greater, defining a rounded section 30. This part of the pull tab, just within the scores, is made thicker than the remainder of the closure 10, providing a downwardly projective plug 31 that fits tightly within the opening 17 in the upper wall 15 of the can 11 for sealing this opening. Preferably an undercut is provided on the circumferential wall of the plug 31 to engage the edge of the opening 17 and retain the plug in the opening. In addition, shorter scores 32 and 33 extend across the width of the pull tab 26 adjacent but spaced a short distance from the plug portion 31, positioned one on either side of the plug.

The closure 10 may be preformed and placed over the upper end of the beverage can 11 after the latter has been filled with liquid, assuming the position of FIGS. 1 and 2. This part of the exterior of the can is sanitized before the closure 10 is installed, such as by the application of steam. As the closure 10 is fitted over the end of the can, there is sufficient deflection to enable the plug portion 31 to snap into place within the opening 17 as the undercut at its periphery fits beneath the edge of the opening. Also the portion 22 of the closure is deflected as the closure is fitted over the bead 14 and this portion snaps into place underneath the bead when the closure is forced over the top of the can. Alternatively, the closure 10 may be formed or molded over the top of the can.

Later, when the can is to be opened, the projecting end 29 of the pull tab is grasped and pulled, causing the pull tab to separate from the remainder of the closure 10 as it tears along the scores 27 and 28. This removal of the pull tab pulls the plug portion 31 from within the opening 17. Completion of the pulling of the tab may cause the closure to be separated into two principal segments, as shown in FIG. 4, and in any event the closure is readily removed from the can in a simple opening operation. This leaves the opening 17 free for dispensing the liquid from the can. If one drinks directly from the can there is assurance that the portions of the can contacted by the lips are sanitary because they have been completely covered by the closure 10. Liquid poured from the can also is uncontaminated Moreover, with the opening 17 being formed in the stamping operation as the can is manufactured, its edges may be made rounded, as indicated above, so that they will not cut and there is no likelihood of injury from the opening of or the drinking from the can 11.

If less than all of the contents of the can 11 are dispensed, the can again may be closed by reinserting the plug portion 31 into the opening 17. To facilitate this, the plug portion is separated from the remainder of the pull tab 26 at scores 32 and 33 which extend across the pull tab on either side of the plug portion 31. This is easily done by a twisting and pulling motion of the plug portion 31 relative to the remainder of the pull tab. This provides a conveniently-sized unit for fitting within the opening 17 and reclosing the can, as shown in FIG. 5.

If desired, the upper wall 15 of the can may be provided with a vent opening 34 which is smaller than and is spaced from the opening 17 in the upper can wall 15. The vent opening, of course, allows air to enter as liquid leaves the can, making it easier to pour or drink from the can. When a vent opening 34 is provided in the can wall 15, as shown in FIGS. 6 and 7, the pull tab 26 is provided with a second plug portion 35 to fit within the vent opening. An undercut may be provided on the plug portion 35 to retain this plug portion within the opening 34 until it is removed by the pull tab. Additional scores 36 and 37 extend across the pull tab to allow the vent plug 35 to be removed from the remainder of the tab when the can is opening. This allows the vent plug to be reintroduced into the vent opening as a separate small unit to effect the closure of the vent opening in the event that not all of the liquid in the can has been dispensed.

The foregoing detailed description is to be clearly understood as given by way of illustration and example only, the spirit and scope of this invention being limited solely by the appended claims.

What is claimed is:

1. In combination with a beverage can having a side wall, an end wall and an opening in said end wall, a closure comprising an integral plastic member, said member including an annular first portion extending complementarily around and covering said side wall adjacent said end wall, and a second portion extending from said first portion and complementarily overlying said end wall, said second portion including a thickened part forming a plug projecting from said second portion into said opening and fitting tightly in said opening to seal the same, said member including a duality of spaced scores extending inwardly from at least one edge of said member, said scores providing weakened portions of said member so as to define a pull tab therebetween, said part of said second portion being between said scores and being a segment of said pull tab, whereby pulling on said tab separates said member and removes said part from said opening, said member including a duality of transverse scores in said second portion intermediate and connecting to said first-mentioned scores and located one on either side of said part of said second portion, whereby said part can be removed from said pull tab for permitting said part to be reinserted into said opening for resealing the same.

* * * * *